US007011081B2

(12) United States Patent
Hrytzak et al.

(10) Patent No.: US 7,011,081 B2
(45) Date of Patent: Mar. 14, 2006

(54) DOUBLE-PINTLE EMISSION CONTROL VALVE HAVING A ONE-PIECE DOUBLE-SEAT ELEMENT

(75) Inventors: Bernard J. Hrytzak, Chatham (CA); Tom Maciejowski, Chatham (CA)

(73) Assignee: Siemens VDO Automotive Inc., Chatham (CA)

( * ) Notice: Subject to any disclaimer, the term of this patent is extended or adjusted under 35 U.S.C. 154(b) by 165 days.

(21) Appl. No.: 10/785,307

(22) Filed: Feb. 24, 2004

(65) Prior Publication Data

US 2005/0183703 A1 Aug. 25, 2005

(51) Int. Cl.
*F01B 47/08* (2006.01)
*F02M 25/07* (2006.01)

(52) U.S. Cl. ..... 123/568.17; 123/568.18; 123/568.26; 251/129.07; 251/282; 251/333

(58) Field of Classification Search ..... 123/568.17, 123/568.18, 568.26; 251/129.07, 129.15, 251/282, 329, 333, 339
See application file for complete search history.

(56) References Cited

U.S. PATENT DOCUMENTS

| | | | | |
|---|---|---|---|---|
| 3,584,539 | A * | 6/1971 | Sugden, Jr. | 137/596.15 |
| 6,601,821 | B1 * | 8/2003 | Tyler | 251/30.02 |
| 2004/0069285 | A1 * | 4/2004 | Telep et al. | 123/568.23 |
| 2004/0134547 | A1 * | 7/2004 | Moreno et al. | 137/625.65 |

FOREIGN PATENT DOCUMENTS

JP 2001-289332 * 10/2001

* cited by examiner

*Primary Examiner*—Erick Solis

(57) ABSTRACT

A cylindrical-walled seat element (50) in a double-pintle (42) EEGR valve (20) is a machined metal part in which two substantially identical apertures (62, 64) collectively span essentially a semi-circumference of the seat element wall (52) and are separated by a narrow axial stabilizer bar (80) in that wall.

20 Claims, 4 Drawing Sheets

DOUBLE-PINTLE EMISSION CONTROL VALVE HAVING A ONE-PIECE DOUBLE-SEAT ELEMENT

FIELD OF THE INVENTION

This invention relates generally to emission control valves that are used in emission control systems associated with internal combustion engines in automotive vehicles. The invention particularly relates to a one-piece, double-seat element in a double-pintle type exhaust gas recirculation (EGR) valve.

BACKGROUND OF THE INVENTION

Controlled engine exhaust gas recirculation is a known technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the fuel-air flow entering the engine for combustion so as to limit the combustion temperature and hence reduce the formation of oxides of nitrogen.

Because they are typically engine-mounted, EGR valves are subject to harsh operating environments that include wide temperature extremes and vibrations. Tailpipe emission requirements impose stringent demands on the control of such valves. An electric actuator, such as a solenoid that includes a sensor for signaling position feedback to indicate the extent to which the valve is open, can provide the necessary degree of control when properly controlled by the engine control system. An EGR valve that is operated by an electric actuator is often referred to as an EEGR valve.

When an engine with which an EEGR valve is used is a diesel engine, further considerations bear on the valve. Because such engines may generate significantly large pressure pulses, attainment of acceptable control may call for the use of a force-balanced EEGR valve so that any influence of exhaust gas pressure on valve control is minimized, and ideally completely avoided. For example, a large pressure pulse should not be allowed to force open an EEGR valve that is being operated to closed position by the solenoid.

A double-pintle type valve can endow an EEGR with a degree of force balance that is substantial enough to minimize the influence of exhaust gas pressure on valve control, for example minimizing the risk that large exhaust pressure pulses will open the EEGR valve when the engine control strategy is calling for the valve to be closed. A double-pintle type valve endows the valve with a split flow path. Each pintle is associated with a respective valve seat, and when the pintles are unseated, the flow that has entered through the inlet port splits in two, with a portion passing through one seat and the remainder through the other. The split flows entrain as they leave the valve through the outlet port. Such a valve can handle larger flow rates with a degree of control suitable for control of EGR.

Because of various factors that bear on an EEGR valve's ability to control tailpipe emissions for compliance with relevant regulations, including considerations already mentioned, construction details of a double-pintle EEGR valve become important. Individual parts must be sufficiently strong, tightly toleranced, thermally insensitive, and essentially immune to combustion products present in engine exhaust gases.

Moreover, in mass-production automotive vehicle applications, the cost-effectiveness of the construction of components, such as that of an EEGR valve, is important.

SUMMARY OF THE INVENTION

The present invention relates to a new and unique construction for an EEGR valve, particularly to the arrangement and construction of a one-piece seat element in a double-pintle, double-seat valve. It is believed that the inventive features contribute to cost-effectiveness and control accuracy of an EEGR valve in an EGR system of a diesel engine in an automotive vehicle.

A general aspect of the invention relates to an emission control valve for use in an emission control system of an internal combustion engine. The valve comprises valve body structure providing an inlet port at which flow enters the valve and an outlet port at which flow exits the valve. A valve element cooperates with a seat element for selectively restricting flow between the inlet port and the outlet port by selectively restricting flow through the seat element. An actuator selectively positions the valve element along an axis relative to the seat element, which comprises first and second valve seats axially spaced apart. The valve element comprises first and second closures axially spaced apart, each closure being arranged to seat on the respective seat for closing flow between the inlet port and the outlet port and to unseat from the respective seat for allowing flow between the inlet port and the outlet port. The seat element comprises an axially extending wall that circumscribes a space between its seats and that contains plural apertures through which that space is in open to one port.

According to a specific embodiment, the seat element is a machined metal part in which the plural apertures are two substantially identical apertures that collectively span essentially a semi-circumference of the seat element wall and are separated by a narrow axial stabilizer bar in the seat element wall.

Another general aspect relates to a method of making such a seat element.

Still another general aspect relates to an engine having an exhaust gas recirculation system that comprises such a valve.

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
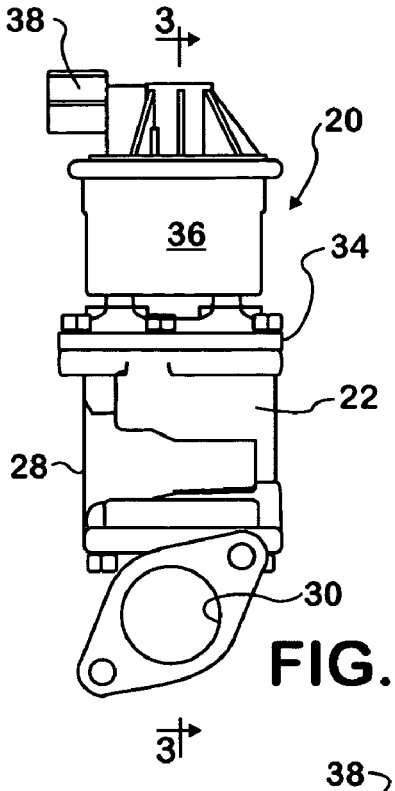
FIG. 1 is an elevation view of an EEGR valve embodying principles of the invention.
Figure 2:
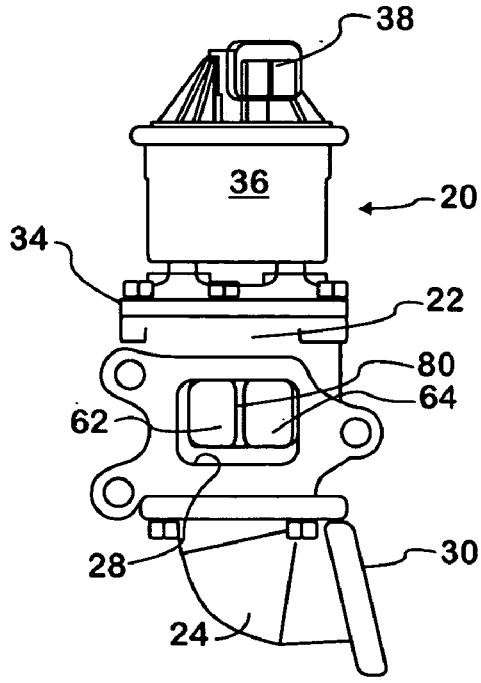
FIG. 2 is a left side elevation view of FIG. 1.
Figure 3:
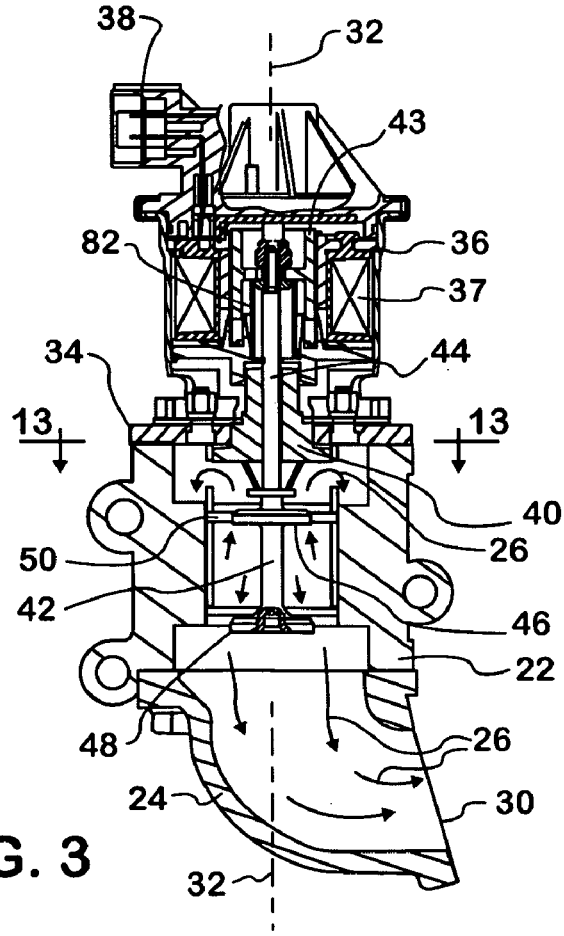
FIG. 3 is an enlarged cross section view in the direction of arrows 3—3 in FIG. 1.

FIGS. 1–3 illustrate an exemplary EEGR valve 20 embodying principles of the present invention. Valve 20 comprises a base 22 and an elbow 24 assembled together to form a flow path 26 through the valve between an inlet port 28 provided in a flange at a side of base 22 and an outlet port 30 provided in a flange at one end of elbow 24.

Base 22 is a metal part that has a main longitudinal axis 32. Base 22 may be considered to have a generally cylindrical shape about axis 32 comprising a generally cylindrical wall bounding an interior space that is open at opposite axial end faces of the base. Base 22 is constructed so that its interior space is also open to inlet port 28.

An end of elbow 24 that is opposite the end containing outlet port 30 is fastened in a sealed manner to the lower end face of base 22 so that the interior of elbow 24 is open to the interior space of base 22. A cover 34 is fastened in a sealed manner to the upper end face of base 22 to close that end of the interior space of base 22 while providing a platform for the mounting of an electric actuator 36 on the exterior of the cover.

Actuator 36 comprises a solenoid 37 that, when the valve is installed on an engine in a motor vehicle, is electrically connected via an electric connector 38 (shown out of position in FIG. 3) to an electrical system of the motor vehicle to place the valve under the control of an engine controller in the vehicle.

Figure 4:
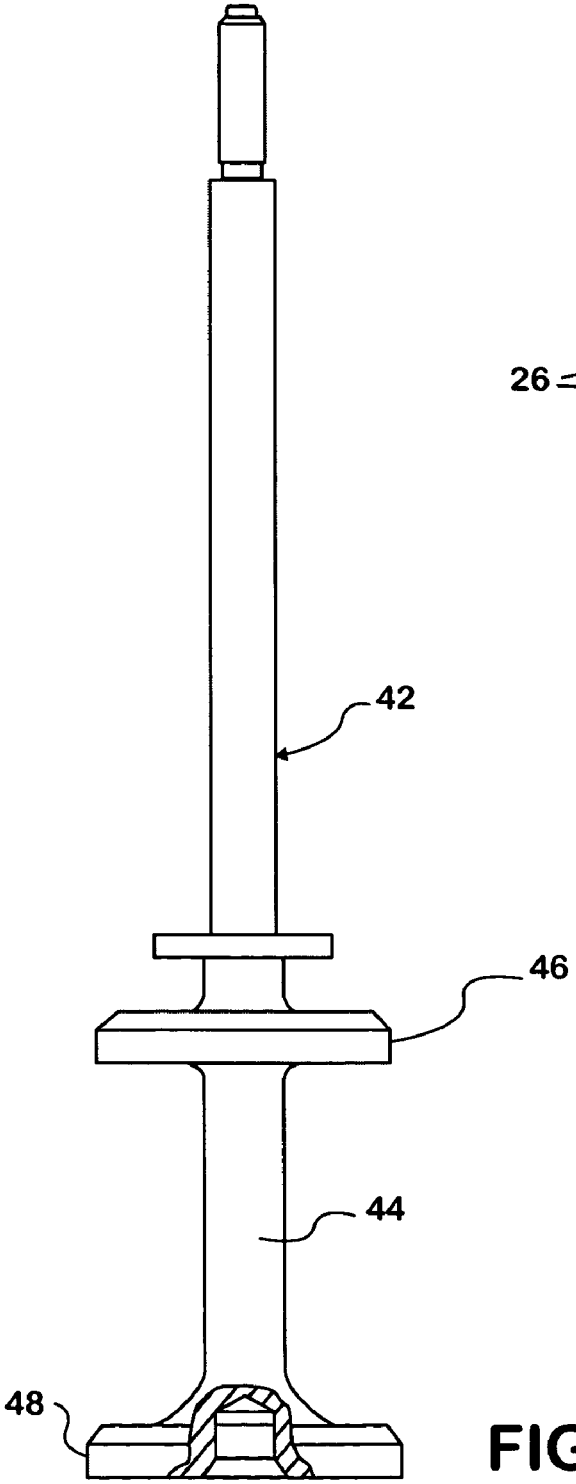
FIG. 4 is an enlarged elevation view of one part of the valve by itself, that part being a double-pintle.
Figure 5:
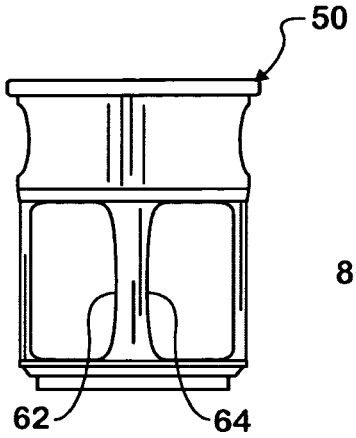
FIG. 5 is an elevation view of another part of the valve by itself, that part being a seat element having a double-seat.
Figure 6:
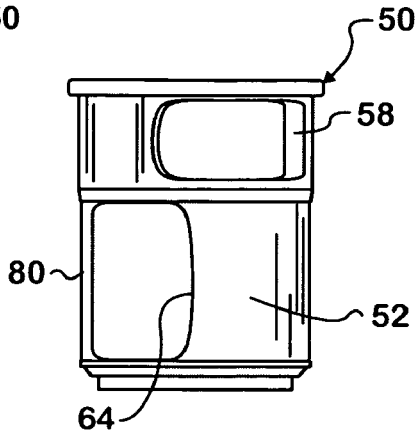
FIG. 6 is a right side elevation view of FIG. 5.
Figure 7:
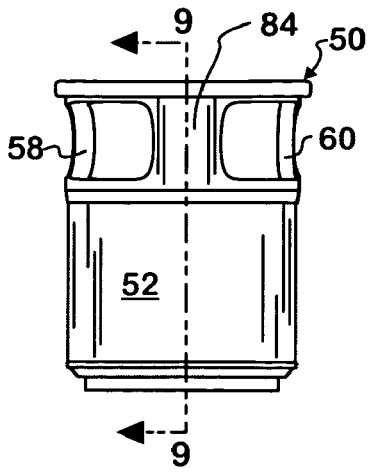
FIG. 7 is a rear elevation view of FIG. 5.
Figure 8A:
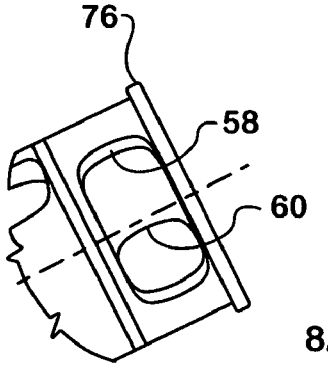
FIG. 8A is a partial projection looking in the direction of arrow 8A in FIG. 8.
Figure 8:
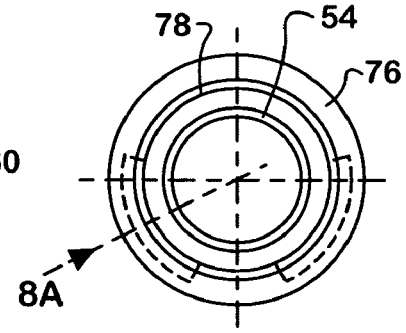
FIG. 8 is a top plan view of FIG. 7.
Figure 10:
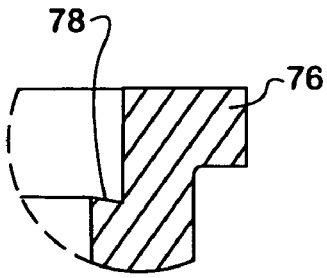
FIG. 10 is an enlarged view in circle 10 in FIG. 9.

A bearing 40 is centrally fit to cover 34 such that a guide bore of the bearing is coaxial with axis 32. Bearing 40 serves to axially guide a double-pintle 42 (shown by itself in FIG. 4) of valve 20 along axis 32 via a guiding fit of the bearing guide bore to an upper portion of a stem 44 of double-pintle 42 that extends completely through the bearing guide bore from an armature 43 of solenoid 37 into the interior space of base 22 where upper and lower pintles 46, 48 are disposed on stem 44.

Figure 13:
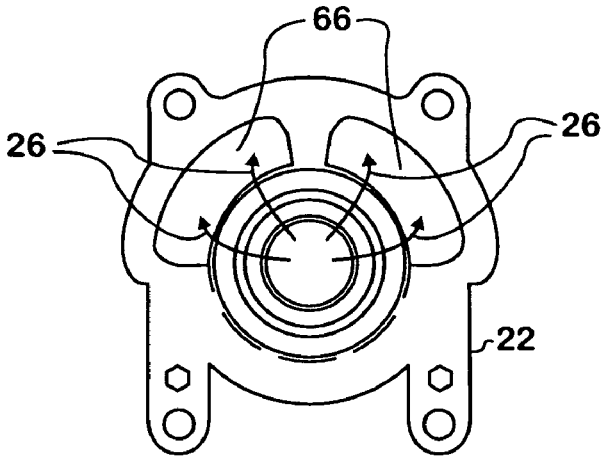
FIG. 13 is a cross section view in the direction of arrows 13—13 in FIG. 3.

A double-seat element 50 shown by itself in FIGS. 5–8, with details in FIGS. 8A–12, is fit to base 22 within the latter's interior space. Element 50 is a machined metal part that has a generally cylindrical shape. It comprises a generally cylindrical wall 52 that is coaxial with axis 32 in valve 20 and that is open at opposite axial ends. Element 50 comprises axially spaced apart upper and lower seats 54, 56 with which pintles 46, 48 respectively cooperate. Wall 52 comprises two pairs of openings, or apertures: an upper pair 58, 60, and a lower pair 62, 64. The lower pair are arranged axially between seats 54, 56 to provide for the open interior of element 50 that is circumscribed by wall 52 between seats 54, 56 to communicate through the opening in base 22 to inlet port 28. The upper pair 58, 60 are arranged axially beyond seat 54 relative to the lower pair 62, 64 to provide for the open interior of element 50 that is circumscribed by wall 52 beyond upper seat 54 to communicate with respective entrances to an internal passageway 66 (see FIG. 13) than runs within base 22 internally through a portion of the generally cylindrical wall of the base that is in the semi-circumferential portion of that wall opposite inlet port 28.

The outside diameter surface of wall 52 is stepped, comprising zones of successively larger diameter from bottom to top so as to allow element 50 to be assembled to base 22 by inserting element 50 into the interior space of base 22 through the opening in the upper end face of the base. The smallest outside diameter zone of wall 52 is at the bottom of element 50 essentially coextensive with seat 56. The next larger diameter zone is the one containing apertures 62, 64, and at the juncture of those two zones is a chamfered shoulder 67 shown more clearly in FIG. 12, which also shows the shape of the inner margin of seat 56 circumscribing the circular through-hole opening in the seat.

Figure 11:
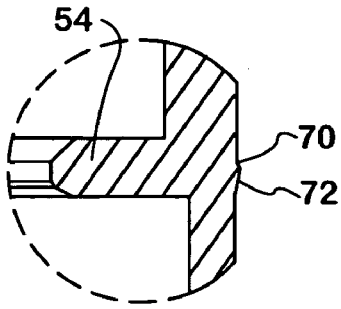
FIG. 11 is an enlarged view in circle 11 in FIG. 9.
Figure 12:
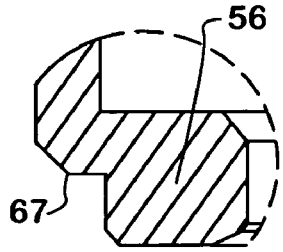
FIG. 12 is an enlarged view in circle 12 in FIG. 9.
Figure 9:
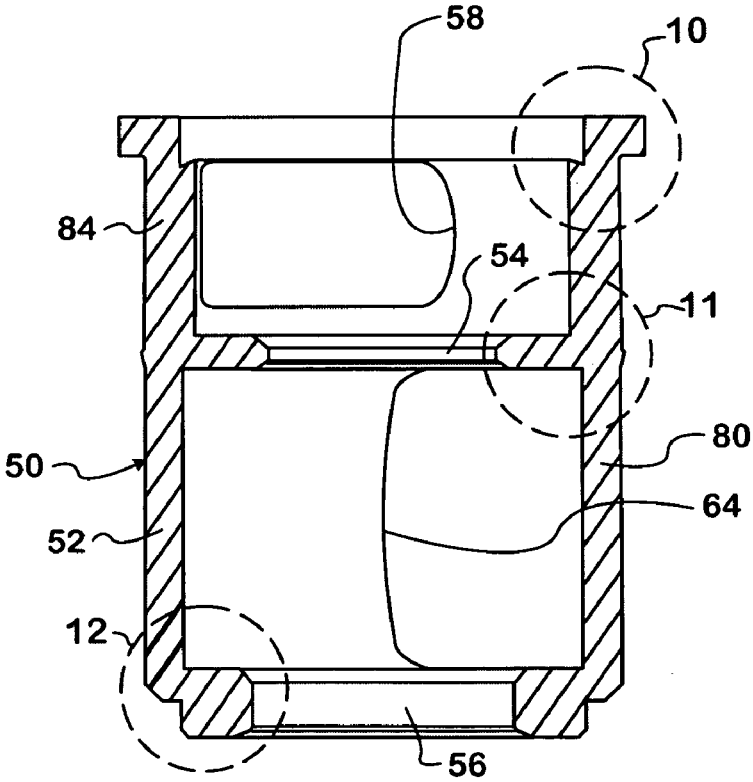
FIG. 9 is an enlarged cross section view in the direction of arrows 9—9 in FIG. 7.

The next larger diameter zone is the one containing apertures 58, 60, and at its juncture with the zone containing apertures 62, 64, there is a raised circular ridge 70 having an inclined surface 72 (see FIG. 11) that wedges with a portion of the inside diameter of the cylindrical wall of base 22 when element 50 is assembled to the base. FIG. 11 also shows the shape of the inner margin of seat 54 circumscribing the circular through-hole opening in the seat. The uppermost zone of wall 52 comprises a circular lip 76 on the outside and an inclined shoulder 78 on the inside.

When element 50 is assembled to base 22, the zone of wall 52 containing apertures 62, 64 fits to the circular inside diameter surface of the wall of base 22 in an orientation about axis 32 that places apertures 62, 64 in registration with inlet port 28, as shown in FIG. 2. Thereafter, a sub-assembly of cover 34, bearing 40, and actuator 36 are assembled to base 22 at the upper end face of the base by fastening the cover to the base. Before elbow 24 is placed on the lower face of base 22, double-pintle 42 is assembled into the valve through the open lower end face of the base. Stem 44 passes through the guide bore in bearing 40 and into the interior of the actuator where it attaches to armature 43. With the solenoid not being energized, each of the two pintles 46, 48 seats on the respective seat 54, 56, closing the respective through-hole. Armature 43 is biased by a spring 82 to urge the pintles against the seats with an appropriate amount of force. A circular flange, or rim, at the lower end of bearing 40 fits to the open upper end of seat element 50.

It can be appreciated that the outside diameter of upper pintle 46 is less than that of the opening circumscribed by lower seat 56 so that the former can pass through the latter during assembly of the double-pintle into the valve. Thereafter elbow 24 is fastened to base 22 to complete the assembly.

Valve is substantially force-balanced because of the double-pintle design. When inlet port 28 is communicated to the engine exhaust system so that hot engine exhaust gases can enter the valve, the pressure of those gases acting on the pintles creates forces that are substantially equal in magnitude, but in opposite directions along axis 32, although the magnitude of force acting on pintle 48 will be slightly larger than that acting on pintle 46. Hence, any influence of exhaust pressure pulses on the positioning of double-pintle 42 by actuator 36 will be minimized. This is important for control accuracy.

For the accurate handling of flow within a rather large range of flow rates, it is also important that the internal construction of the valve be substantially immune to the effects of exhaust gas constituents, exhaust gas temperature extremes, and exhaust gas pressure extremes. Parts that are important to control accuracy need strict manufacturing tolerances. Restriction of the flow path through the valve should be determined by the positioning of the valve element in relation to the valve seat, meaning that the design of other parts of the valve that define the flow path should impose a restriction that is essentially negligible when compared to the restriction between the valve element and the valve seat.

These objectives are best met by rigid metal parts that can be machined to the required dimensional accuracy.

In accordance with principles of the invention, a double-pintle valve, as described, splits the entering exhaust gas flow so that the flow divides more or less equally as it passes through seat element 50. Ideally there should be essentially no restriction to the incoming flow entering the seat element from inlet port 28. For maximizing the cross sectional area through which the incoming flow enters seat element 50, the circumferential span of the opening in the wall of seat element 50 should be essentially its semi-circumference. Collectively, apertures 62, 64 do just that. But in order to minimize the wall thickness of the seat element while retaining the necessary degree of strength, rigidity, and dimensional accuracy of the seat element, the seat element is a machined part where the two apertures 62, 64 are separated by a narrow axial stabilizer bar 80 in the wall, rather than being a single aperture having the same overall semi-circumferential span.

Similarly apertures 58, 60 collectively span somewhat more than a semi-circumference and are separated by an axial bar 84 that is diametrically opposite bar 80, but bar 84 need not be as narrow as bar 80 because only a portion of the exhaust passes through apertures 58, 60. The axial dimensional of apertures 58, 60 can be less than that of apertures 62, 64 because of the splitting of the exhaust flow after it has passed through the latter.

While the foregoing has described a preferred embodiment of the present invention, it is to be appreciated that the inventive principles may be practiced in any form that falls within the scope of the following claims.

What is claimed is:

1. An emission control valve for use in an emission control system of an internal combustion engine comprising:

valve body structure providing an inlet port at which flow enters the valve, an outlet port at which flow exits the valve, a valve element cooperating with a seat element for selectively restricting flow between the inlet port and the outlet port by selectively restricting flow through the seat element, an actuator for selectively positioning the valve element along an axis relative to the seat element, wherein the seat element comprises first and second valve seats axially spaced apart and the valve element comprises first and second closures axially spaced apart, each closure arranged to seat on the respective seat for closing flow between the inlet port and the outlet port and to unseat from the respective seat for allowing flow between the inlet port and the outlet port, and wherein the seat element comprises an axially extending wall that circumscribes a space between its seats and that contains plural apertures through which that space is open to one port.

2. A valve as set forth in claim 1 wherein the plural apertures comprise two apertures spanning essentially a semi-circumference of the seat element and separated by an axially extending bar in the wall.

3. A valve as set forth in claim 2 wherein the two apertures have essentially identical open areas.

4. A valve as set forth in claim 1 wherein the seat element is a machined metal part.

5. A valve as set forth in claim 1 wherein the one port is the inlet port through which flow enters the valve, and the first and second closures impart some degree of force-balance to the valve.

6. A valve as set forth in claim 1 wherein the valve body structure comprises a base, and the seat element is a separate part disposed within an interior space of the base.

7. A valve as set forth in claim 1 wherein a portion of the wall extends axially beyond one of the seats and contains at least one aperture through which space circumscribed by that portion of the wall is open to the other port.

8. A valve as set forth in claim 7 wherein the valve body structure comprises a base having an interior within which the seat element is disposed, and the at least one aperture opens to a passageway that runs through a wall of the base to the other port.

9. A valve as set forth in claim 7 wherein the at least one aperture comprises two apertures collectively spanning more than a semi-circumference of the seat element and separated by an axially extending bar in the wall.

10. A valve as set forth in claim 9 wherein the plural apertures comprise two apertures spanning essentially a semi-circumference of the seat element and separated by another axially extending bar in the wall, the two bars being substantially diametrically opposite each other.

11. A method of making a seat element for a double-pintle valve, the method comprising:

providing a cylindrical walled metal part, processing the part to create two axially spaced apart seats for seating respective closures of a double-pintle, two through-apertures separated by an axial bar in the cylindrical wall axially between the seats, and at least one through-aperture in the cylindrical wall axially beyond one seat relative to the other seat.

12. A method as set forth in claim 11 further comprising:

processing the part to create the at least one through-aperture in the cylindrical wall axially beyond one seat relative to the other seat as two through-apertures separated by another axial bar in the wall.

13. An internal combustion engine comprising an exhaust gas recirculation system for recirculating some engine exhaust gas through the engine via an exhaust gas recirculation valve external to engine combustion chambers wherein the valve comprises valve body structure providing an inlet port at which exhaust enters the valve, an outlet port at which exhaust exits the valve, a valve element cooperating with a seat element for selectively restricting flow between the inlet port and the outlet port by selectively restricting flow through the seat element, an actuator for selectively positioning the valve element along an axis relative to the seat element, wherein the seat element comprises first and second valve seats axially spaced apart and the valve element comprises first and second closures axially spaced apart, each closure arranged to seat on the respective seat for closing flow between the inlet port and the outlet port and to unseat from the respective seat for allowing flow between the inlet port and the outlet port, and wherein the seat element comprises an axially extending wall that circumscribes a space between its seats and that contains plural apertures through which that space is in open to the inlet port.

14. An engine as set forth in claim 13 wherein the plural apertures comprise two apertures spanning essentially a semi-circumference of the seat element and separated by an axially extending bar in the wall.

15. An engine as set forth in claim 14 wherein the two apertures have essentially identical open areas.

16. An engine as set forth in claim 13 wherein the first and second closures impart some degree of force-balance to the valve.

17. An engine as set forth in claim 13 wherein a portion of the wall extends axially beyond one of the seats and contains at least one aperture through which space circumscribed by that portion of the wall is open to the outlet port.

18. An engine as set forth in claim 17 wherein the valve body structure comprises a base having an interior within which the seat element is disposed, and the at least one aperture opens to a passageway that runs through a wall of the base to the outlet port.

19. An engine as set forth in claim 17 wherein the at least one aperture comprises two apertures collectively spanning more than a semi-circumference of the seat element and separated by an axially extending bar in the wall.

20. An engine as set forth in claim 13 wherein the engine comprises a diesel engine and the exhaust gas recirculation system recirculates diesel exhaust gases.

* * * * *